US006872127B2

(12) United States Patent
Lin et al.

(10) Patent No.: US 6,872,127 B2
(45) Date of Patent: Mar. 29, 2005

(54) POLISHING PAD CONDITIONING DISKS FOR CHEMICAL MECHANICAL POLISHER

(75) Inventors: Yu-Liang Lin, Hsin-Chu (TW); Henry Lo, Hsin-Chu (TW); Ping Chuang, Taichung (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 10/194,894

(22) Filed: Jul. 11, 2002

(65) Prior Publication Data

US 2004/0009742 A1 Jan. 15, 2004

(51) Int. Cl.[7] ..... B24B 1/00
(52) U.S. Cl. ..... 451/56; 451/443
(58) Field of Search ..... 451/56, 41, 443, 451/285

(56) References Cited

U.S. PATENT DOCUMENTS 6,371,838 B1 * 4/2002 Holzapfel ..... 451/72
6,419,574 B1 * 7/2002 Takahashi et al. ..... 451/548
6,439,986 B1 * 8/2002 Myoung et al. ..... 451/443
6,488,570 B1 * 12/2002 James et al. ..... 451/36

* cited by examiner

*Primary Examiner*—Eileen P. Morgan
(74) *Attorney, Agent, or Firm*—Tung & Associates

(57) ABSTRACT

The invention relates to disks for conditioning pads used in the chemical mechanical polishing of semiconductor wafers, and a method of fabricating the pads. In one embodiment, the conditioning pad includes multiple, pyramid-shaped, truncated protrusions which are cut or shaped in the surface of a typically stainless steel substrate. Each of the truncated protrusions includes a plateau in the top thereof. A seed layer, typically titanium nitride (TiN), is provided on the surface of the protrusions, and a contact layer such as diamond-like carbon (DLC) or other suitable film is provided over the seed layer. In another embodiment, each of the protrusions is pyramid-shaped and includes a pointed apex at the top thereof.

20 Claims, 3 Drawing Sheets

POLISHING PAD CONDITIONING DISKS FOR CHEMICAL MECHANICAL POLISHER

FIELD OF THE INVENTION

The present invention relates to disks used in the conditioning of polishing pads on chemical mechanical polishers for semiconductor wafers. More particularly, the present invention relates to a polishing pad conditioning disk having improved surface configurations for conditioning polishing pads in chemical mechanical polishers.

BACKGROUND OF THE INVENTION

Apparatus for polishing thin, flat semiconductor wafers are well-known in the art. Such apparatus normally includes a polishing head which carries a membrane for engaging and forcing a semiconductor wafer against a wetted polishing surface, such as a polishing pad. Either the pad or the polishing head is rotated and oscillates the wafer over the polishing surface. The polishing head is forced downwardly onto the polishing surface by a pressurized air system or similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head, a wafer unload station, or a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in deionized water.

A schematic of a typical CMP apparatus is shown in FIGS. 1A and 1B. The apparatus 20 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films.

CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing, a metal oxide may be formed and removed separately.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel.

In a CMP head, large variations in the removal rate, or polishing rate, across the whole wafer area are frequently observed. A thickness variation across the wafer is therefore produced as a major cause for wafer non-uniformity. In the improved CMP head design, even though a pneumatic system for forcing the wafer surface onto a polishing pad is used, the system cannot selectively apply different pressures at different locations on the surface of the wafer. This effect is shown in FIG. 1C, i.e. in a profilometer trace obtained on an 8-inch wafer. The thickness difference between the highest point and the lowest point on the wafer is almost 2,000 angstroms, resulting in a standard deviation of 472 angstroms, or 6.26%. The curve shown in FIG. 1C is plotted with the removal rates in the vertical axis and the distance from the center of the wafer in the horizontal axis. It is seen that the removal rates obtained at the edge portions of the wafer are substantially higher than the removal rates at or near the center of the wafer. The thickness uniformity on the resulting wafer after the CMP process is poor.

The polishing pad 12 is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surfaces. The hard pads and the soft pads may also be combined in an arrangement of stacked pads for customized applications.

A problem frequently encountered in the use of polishing pads in oxide planarization is the rapid deterioration in oxide polishing rates with successive wafers. The cause for the deterioration is known as "pad glazing", wherein the surface of a polishing pad becomes smooth such that slurry is no longer held in between the fibers of the pad. This physical phenomenon on the pad surface is not caused by any chemical reactions between the pad and the slurry.

To remedy the pad glazing effect, numerous techniques of pad conditioning or scrubbing have been proposed to regenerate and restore the pad surface and thereby restore the polishing rates of the pad. The pad conditioning techniques include the use of silicon carbide particles, diamond emery paper, blade or knife for scraping or scoring the polishing pad surface. The goal of the conditioning process is to remove polishing debris from the pad surface and re-open pores in the pad by forming micro-scratches in the surface of the pad for improved pad lifetime. The pad conditioning process can be carried out either during a polishing process, i.e. known as concurrent conditioning, or after a polishing process.

While the pad conditioning process improves the consistency and lifetime of a polishing pad, a conventional conditioning disk is frequently not effective in conditioning a pad surface after repeated usage. A conventional conditioning disk for use in pad conditioning is shown in FIGS. 2A, 2B and 2C.

Referring next to FIG. 2A, a conventional CMP apparatus 50 includes a conditioning head 52, a polishing pad 56, and a slurry delivery arm 54 positioned over the polishing pad. The conditioning head 52 is mounted on a conditioning arm 58 which is extended over the top of the polishing pad 56 for making a sweeping motion across the entire surface of the polishing pad 56. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad 56 during a polishing process. The surface grooves 64, while serving an important function of distributing the slurry, also presents a processing problem when the pad surface 60 gradually wears out after prolonged use.

The conventional conditioning disk 68 may be of several different types, two of which are shown in cross-section in FIGS. 2B and 2C. A conventional brazed grid-type conditioning disk 68, shown in FIG. 2B, is formed by embedding or encapsulating diamond particles 72 in random spacings with each other in the surface of a stainless steel substrate 70. A conventional dia grid-type conditioning disk 68, shown in FIG. 2C, is formed by embedding cut diamonds 80 at regular spacings in a nickel film 82 coated onto the surface of a stainless steel substrate 78. The diamonds 80 are typically coated with a diamond-like carbon (DLC) layer 83. One of the problems associated with the conventional conditioning disks 68 is that the polishing slurry tends to easily damage the nickel film holding the diamonds onto the substrate, and this causes the diamonds to drop from the disk onto the polishing pad and scratch the surface of the wafer during the CMP process. Furthermore, use of diamonds in the disk is excessively costly, as the diamonds are lost from the polishing pads over a typical pad lifetime of from 10–50 hours.

Accordingly, an object of the present invention is to provide new and improved conditioning disks for conditioning polishing pads used in the chemical mechanical polishing (CMP) of semiconductor wafers.

Another object of the present invention is to provide a CMP conditioning disks which are characterized by increased lifetime and durability.

Still another object of the present invention is to provide CMP conditioning disks which are inexpensive to manufacture and use.

Yet another object of the present invention is to provide CMP conditioning disks which are capable of effectively conditioning CMP pads while preventing or minimizing particle contamination of wafers polished by the pads.

Another object of the present invention is to provide CMP conditioning disks which do not provide a source of potential particulate contaminants for a polishing pad or semiconductor wafer during a CMP process.

A still further object of the present invention is to provide CMP conditioning disks which enable fine-tuning chemical mechanical polishing process parameters in order to optimize chemical mechanical polishing of semiconductor wafers.

Still another object of the present invention is to provide CMP conditioning disks having multiple protrusions arranged in a uniformly-spaced pattern on the surface of each disk and which protrusions are substantially uniform in shape, size and quality.

Yet another object of the present invention is to provide a method of fabricating a new and improved CMP conditioning disk.

SUMMARY OF THE INVENTION

In accordance with these and other objects and advantages, the present invention comprises new and improved disks for conditioning pads used in the chemical mechanical polishing of semiconductor wafers, and a method of fabricating the pads. In one embodiment, the conditioning pad includes multiple, pyramid-shaped, truncated protrusions which are cut or shaped in the surface of a typically stainless steel substrate. Each of the truncated protrusions includes a plateau in the top thereof. A seed layer typically of titanium nitride (TiN) is provided on the surface of the protrusions, and a contact layer of diamond-like carbon (DLC) or other suitable film is provided over the seed layer. In another embodiment, each of the protrusions is pyramid-shaped and includes a pointed apex at the top thereof. When mounted on a conditioning head of a chemical mechanical polisher, the protrusions are effective in scoring or scratching a CMP polishing pad to enhance retention of slurry in the polishing pad during a CMP operation.

In both embodiments of the present invention, the pyramidal protrusions are separated by a network of grooves cut or shaped in the typically stainless steel substrate. The depth of the grooves typically ranges from about 0.1 mm to about 3 mm, whereas the height of the protrusions typically ranges from about 0.2 mm to about 5 mm. The width of the top or extending portion of each pyramid-shaped protrusion ranges from about 0 (in the case of the protrusions having an apex) to about 5 mm (in the case of the truncated protrusions having the plateau shaped in the upper end thereof). The thickness of the seed layer on the protrusions and grooves ranges from typically about 10 $\mu$m to about 2000 $\mu$m, whereas the thickness of the contact layer on the seed layer ranges from typically about 5 $\mu$m to about 500 $\mu$m.

Each of the conditioning disks of the present invention may be fabricated by initially providing a circular stainless steel substrate which is typically about 4 inches in diameter. Next, multiple grooves are etched into the surface of the substrate using conventional mechanical means. This step forms the multiple pyramid-shaped protrusions on the substrate, with the network of grooves separating the protrusions. In the case of the truncated protrusions, the upper portion of each protrusion is next removed. Next, the seed film is deposited on the substrate and provides a continuous coating on both the grooves and the protrusions on the substrate surface. The seed layer enhances adhesion of the substrate on the contact layer, which is then deposited on the seed layer as a final step in the fabrication process.

BRIEF DESCRIPTION OF THE DRAWINGS

The invention will now be described, by way of example, with reference to the accompanying drawings, wherein:

FIG. 1B is an enlarged, cross-sectional view of a section of a wafer and the polishing pad of a conventional CMP apparatus, with a slurry solution there between;

DESCRIPTION OF THE PREFERRED EMBODIMENTS

Figure 1A:
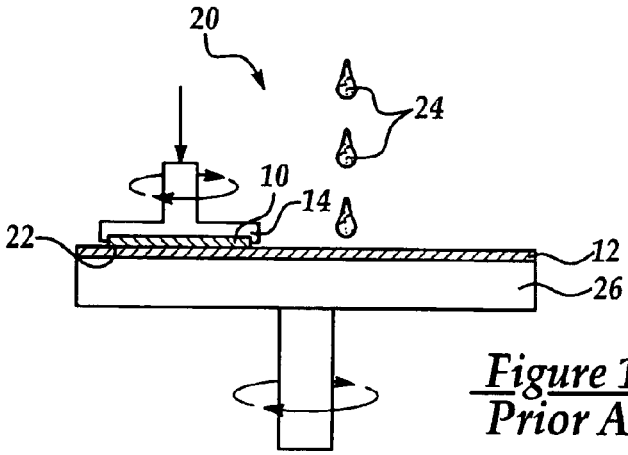
Figure 1A Prior Art
FIG. 1A is a cross-sectional view of a typical conventional chemical mechanical polishing (CMP) apparatus.
Figure 1B:
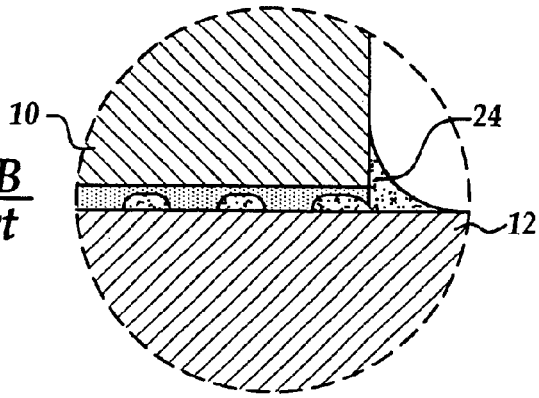
Figure 1B Prior Art
Figure 1C:
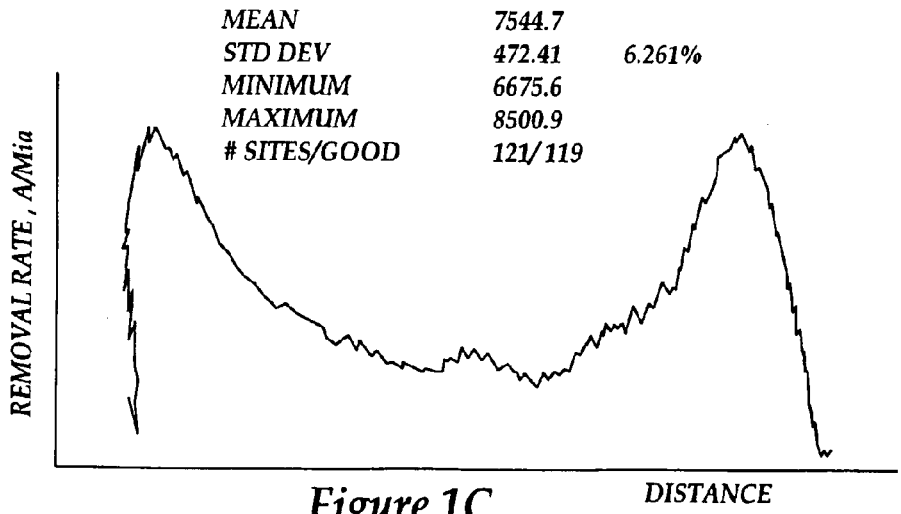
Figure 1C Prior Art
FIG. 1C is a graph illustrating the changes in removal rates as a function of distance on a wafer after a polishing pad is repeatedly used.
Figure 2A:
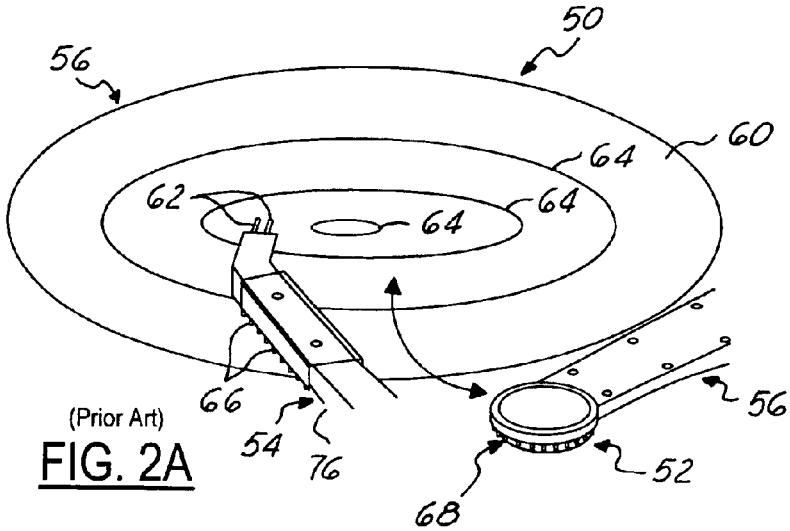
(Prior Art) FIG. 2A
FIG. 2A is a perspective view of a conventional CMP polishing pad with a slurry dispensing arm and a conditioning disk positioned on top.
Figure 2B:
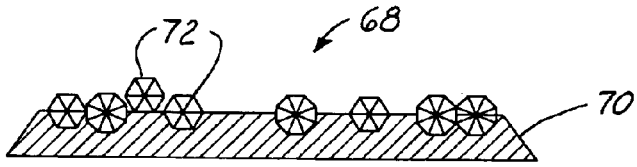
(Prior Art) FIG. 2B
FIG. 2B is a cross-sectional view of a conventional, brazed-type diamond conditioning disk.
Figure 2C:
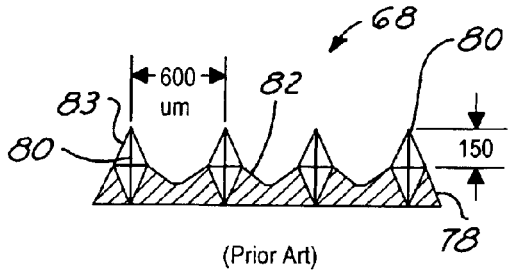
(Prior Art) FIG. 2C
FIG. 2C is a cross-sectional view of a conventional, dia grid diamond conditioning disk.
Figure 3:
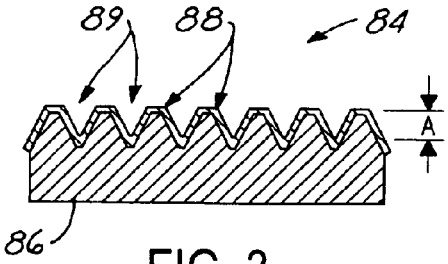
FIG. 3 is a cross-sectional view of a first embodiment of the conditioning disk of the present invention.
Figure 4:
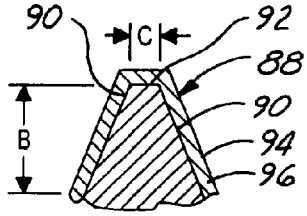
FIG. 4 is a cross-sectional view of a protrusion component of the conditioning disk illustrated in FIG. 3.
Figure 5:
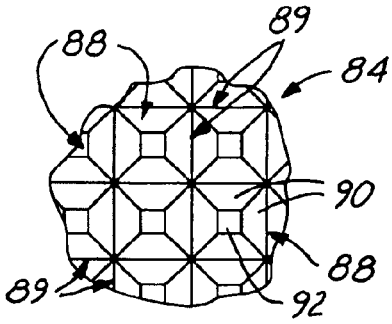
FIG. 5 is a top view, partially in section, of the conditioning disk illustrated in FIG. 3.

Referring initially to FIGS. 3–5, a first illustrative embodiment of a conditioning disk of the present invention is generally indicated by reference numeral 84 and includes a substrate 86 which is typically a circular plate of stainless steel #316. It is understood, however, that other metals or grades of steel may be used as the substrate 86. Multiple pyramid-shaped protrusions 88 are cut or otherwise formed in the upper surface of the substrate 86. As illustrated in FIG. 5, each protrusion 88 typically includes four sides 90 and a plateau 92. A network of intersecting perpendicular grooves 89 separate adjacent protrusions 88 from each other. As particularly illustrated in FIG. 4, a seed layer 94, such as titanium nitride (TiN), is deposited on the substrate 86 and coats the surface of the sides 90 and plateau 92 of each protrusion 88, as well as the surfaces of the grooves 89. The seed layer 94 provides adhesion for a contact layer 96 subsequently deposited on the seed layer 94, which contact layer 96 is typically diamond-like carbon (DLC) or alternatively, a CVD diamond film layer.

In a typical embodiment, each groove 89 has a depth, designated by the letter "A" in FIG. 3, typically in the range of from about 0.1 mm to about 3 mm. Each protrusion 88 has a height, designated by the letter "B" in FIG. 4, in the range of from about 0.2 mm to about 5 mm. The plateau 92 of each protrusion 88 has a width of up to about 5 mm. The seed layer 94 has a thickness of from about 10 $\mu$m to about 2000 $\mu$m, whereas the thickness of the contact layer 96 on the seed layer 94 ranges from typically about 5 $\mu$m to about 500 $\mu$m.

Figure 10:
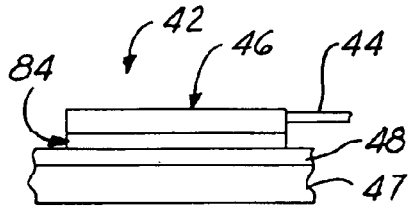
FIG. 10 is a side view, partially in section, of a conditioning head, with a conditioning disk of the present invention mounted on the conditioning head in use of the conditioning disk to condition a CMP polishing pad (in section).

Referring next to FIG. 10, a CMP apparatus 42 is shown in typical application of the conditioning disk 84, which is mounted face-down, according to methods which are well-known by those skilled in the art, on a conditioning head 46 provided on the end of a conditioning arm 44 of the CMP apparatus 42. A polishing pad 48 is supported on a platen 47 of the CMP apparatus 42, and the platen 47 and conditioning head 46 are simultaneously rotated according to parameters which are known by those skilled in the art. Accordingly, as the platen 47 rotates the polishing pad 48, the conditioning head 46 simultaneously rotates the conditioning disk 84 mounted thereon, and the protrusions 88 (FIG. 3) extending downwardly from the surface of the conditioning disk 84 scratch and score the upper surface of the polishing pad 48. This may be carried out as a wafer (not illustrated) rests on the polishing pad 48 during a CMP operation, or alternatively, during a conditioning process in which a CMP operation is not being carried out on the polishing pad 48. The scratches made in the surface of the polishing pad 48 facilitate enhanced retention of polishing slurry (not illustrated) on the polishing pad 48 during CMP operations. Furthermore, the typically stainless steel protrusions 88 are incapable of inadvertently breaking off from the substrate 86 of the conditioning disk 84 and dropping on the polishing pad 48 and potentially contaminating a wafer (not illustrated) on the polishing pad 48 during a CMP operation.

Figure 6:
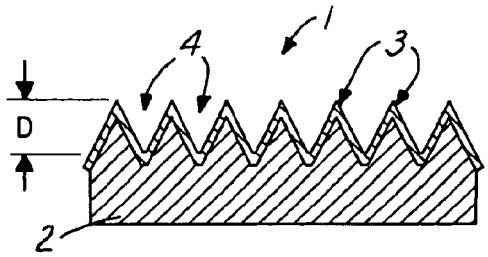
FIG. 6 is a cross-sectional view of a second embodiment of the conditioning disk of the present invention.
Figure 7:
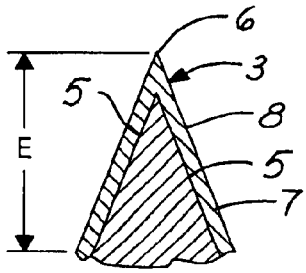
FIG. 7 is a cross-sectional view of a protrusion of the conditioning disk illustrated in FIG. 6.
Figure 8:
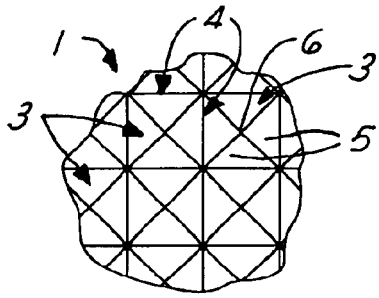
FIG. 8 is a top view, partially in section, of the conditioning disk illustrated in FIG. 6.

Referring next to FIGS. 6–8, a second illustrative embodiment of the conditioning disk of the present invention is generally indicated by reference numeral 1 and includes a substrate 2 which is typically a circular plate of stainless steel #316. It is understood, however, that other metals or grades of steel may be used as the substrate 2. Multiple pyramid-shaped protrusions 3 are cut or otherwise formed in the upper surface of the substrate 2. As illustrated in FIG. 8, each protrusion 3 typically includes four sides 5 which meet at an apex 6. A network of perpendicular intersecting grooves 4 separate adjacent protrusions 3 from each other. As particularly illustrated in FIG. 7, a seed layer 7, typically titanium nitride (TiN), coats the surface of the sides 5 and apex 6 of each protrusion 3, as well as the surfaces of the grooves 4. The seed layer 7 provides adhesion for a contact layer 8 subsequently deposited on the seed layer 7, which seed layer 7 is typically diamond-like carbon (DLC) or alternatively, a CVD diamond film layer.

In a typical embodiment, each groove 4 of the conditioning disk 1 has a depth, designated by the letter "D" in FIG. 6, typically in the range of from about 0.1 mm to about 3 mm. Each protrusion 3 has a height, designated by the letter "E" in FIG. 7, in the range of from typically about 0.2 mm to about 5 mm. The apex 6 of each protrusion 3 has a width of typically from about 0 mm to about 5 mm. The seed layer 7 has a thickness of from about 10 $\mu$m to about 2000 $\mu$m, whereas the thickness of the contact layer 8 on the seed layer 7 ranges from typically about 5 $\mu$m to about 500 $\mu$m.

In application, and referring again to FIG. 10, the conditioning disk 1 is mounted on the conditioning head 46 of the CMP apparatus 42 and rotated in conjunction with the polishing pad 48 on the platen 47 in the same manner as heretofore described with respect to the conditioning disk 84. Accordingly, as the platen 47 rotates the polishing pad 48, the conditioning head 46 simultaneously rotates the conditioning disk 1 mounted thereon, and the protrusions 3 (FIG. 6) extending downwardly from the surface of the conditioning disk 1 scratch and score the upper surface of the polishing pad 48. This may be carried out as a wafer (not illustrated) rests on the polishing pad 48 during a CMP operation, or alternatively, during a conditioning process in which a CMP operation is not being carried out on the polishing pad 48. The scratches made in the surface of the polishing pad 48 facilitate enhanced retention of polishing slurry (not illustrated) on the polishing pad 48 during CMP operations. Furthermore, the typically stainless steel protrusions 3 are incapable of inadvertently breaking off from the substrate 2 of the conditioning disk 1 and dropping on the polishing pad 48 and potentially contaminating a wafer (not illustrated) on the polishing pad 48 during a CMP operation.

Figure 9:
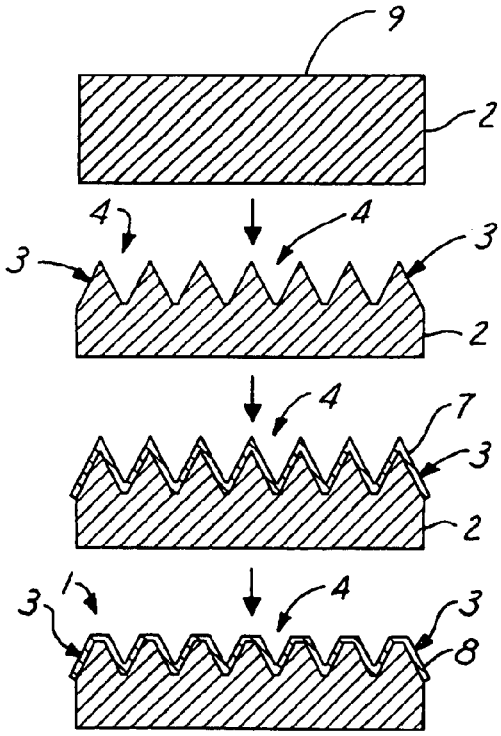
FIG. 9 is a flow diagram illustrating an illustrative method of fabricating a conditioning disk of the present invention.

A typical method of manufacturing a conditioning disk 1 of the present invention is outlined in FIG. 9. First, the protrusions 3 and grooves 4 are cut into the upper surface 9 of the blank substrate 2 using conventional mechanical techniques. The substrate 2 is typically a circular plate of stainless steel #316 or other steel grade or suitable metal, and is typically about 4 inches in diameter. After the protrusions 3 and grooves 4 have been cut in the substrate 2, the protrusions 3 and grooves 4 are coated with the seed layer 7, typically a film of TiN having a thickness of from about 10 $\mu$m to about 2000 $\mu$m, using conventional chemical vapor deposition (CVD) techniques. Next, the contact layer 8, typically a layer of diamond-like carbon (DLC) or CVD diamond film, is deposited on the seed layer 7 typically using conventional CVD techniques. The contact layer 8 typically has a thickness of from about 5 $\mu$m to about 500 $\mu$m.

While the fabricating method outlined in FIG. 9 describes a typical process for fabricating the conditioning disk 1 having the protrusions 3 with the respective apices 6, it is understood that the method heretofore described with respect to FIG. 9 is equally applicable to fabricating the conditioning disk 84 having the protrusions 88 with the plateaus 92 instead of the apices 6. In fabricating the conditioning disk 84, however, the plateaus 92 are formed in the respective protrusions 88 prior to depositing the seed layer 94 and contact layer 96 (FIG. 4) on the conditioning disk 84.

While the preferred embodiments of the invention have been described above, it will be recognized and understood that various modifications may be made in the invention and the appended claims are intended to cover all such modifications which may fall within the spirit and scope of the invention.

Having described our invention with the particularity set forth above, we claim:

1. A conditioning disk comprising:

a rigid, non-brittle substrate;

a plurality of generally pyramid-shaped protrusions extending from said substrate in a matrix of rows and columns;

a plurality of grooves extending between said plurality of protrusions;

a seed layer provided on said plurality of protrusions; and a contact layer provided on said seed layer.

2. The conditioning disk of claim 1 wherein each of said plurality of protrusions has a height of from about 0.2 mm to about 5 mm.

3. The conditioning disk of claim 1 wherein each of said plurality of grooves has a depth of from about 0.1 mm to about 3 mm.

4. The conditioning disk of claim 3 wherein each of said plurality of protrusions has a height of from about 0.2 mm to about 5 mm.

5. The conditioning disk of claim 1 wherein said seed layer has a thickness of from about 10 $\mu$m to about 2000 $\mu$m.

6. The conditioning disk of claim 5 wherein each of said plurality of protrusions has a height of from about 0.2 mm to about 5 mm.

7. The conditioning disk of claim 5 wherein each of said plurality of grooves has a depth of from about 0.1 mm to about 3 mm.

8. The conditioning disk of claim 1 wherein said contact layer has a thickness of from about 5 $\mu$m to about 500 $\mu$m.

9. A conditioning disk comprising:

a stainless steel substrate;

a plurality of pyramid-shaped protrusions extending from said substrate;

a plurality of intersecting grooves extending between said plurality of protrusions;

a seed layer provided on said plurality of protrusions; and a contact layer provided on said seed layer.

10. The conditioning disk of claim 9 wherein each of said plurality of protrusions has a height of from about 0.2 mm to about 5 mm.

11. The conditioning disk of claim 9 wherein each of said plurality of grooves has a depth of from about 0.1 mm to about 3 mm.

12. The conditioning disk of claim 11 wherein each of said plurality of protrusions has a height of from about 0.2 mm to about 5 mm.

13. The conditioning disk of claim 9 wherein said seed layer has a thickness of from about 10 $\mu$m to about 2000 $\mu$m.

14. The conditioning disk of claim 13 wherein each of said plurality of protrusions has a height of from about 0.2 mm to about 5 mm.

15. The conditioning disk of claim 13 wherein each of said plurality of grooves has a depth of from about 0.1 mm to about 3 mm.

16. The conditioning disk of claim 9 wherein said contact layer has a thickness of from about 5 $\mu$m to about 500 $\mu$m.

17. A method of fabricating a conditioning disk, comprising the steps of:

providing a rigid, non-brittle substrate having a planar surface;

cutting a plurality of generally pyramid-shaped protrusions arranged in a matrix of column and rows and a plurality of intersecting grooves between said protrusions in said planar surface of said substrate;

providing a seed layer on said plurality of protrusions and said plurality of grooves; and providing a contact layer on said seed layer.

18. The method of claim 17 wherein said seed layer comprises titanium nitride.

19. The method of claim 17 wherein said contact layer comprises diamond-like carbon.

20. The method of claim 17 wherein said contact layer comprises CVD diamond film.

* * * * *